US006739275B2

(12) United States Patent
Darling et al.

(10) Patent No.: US 6,739,275 B2
(45) Date of Patent: May 25, 2004

(54) BOAT HOOK ATTACHMENT

(76) Inventors: Garritt A. Darling, 9035 SE. Bobwhite St., Hobe Sound, FL (US) 33455; Irene L. Olson, 9035 SE. Bobwhite St., Hobe Sound, FL (US) 33455

( * ) Notice: Subject to any disclaimer, the term of this patent is extended or adjusted under 35 U.S.C. 154(b) by 0 days.

(21) Appl. No.: 10/268,588

(22) Filed: Oct. 9, 2002

(65) Prior Publication Data

US 2004/0069199 A1 Apr. 15, 2004

(51) Int. Cl.[7] ..... B63B 9/00
(52) U.S. Cl. ..... 114/221 R
(58) Field of Search ..... 114/221 R, 230.1, 114/230.15

(56) References Cited

U.S. PATENT DOCUMENTS 1,852,629 A * 4/1932 Sturges ..... 114/230.15
3,841,685 A 10/1974 Kolodziej
4,004,539 A 1/1977 Wesson
4,009,181 A 2/1977 Berger et al.
4,557,214 A * 12/1985 Molitor ..... 114/221 R
5,699,748 A 12/1997 Linskey, Jr. et al.
5,946,844 A * 9/1999 Stoliar et al. ..... 43/17.2
6,409,240 B1 * 6/2002 Ferguson ..... 294/19.1

* cited by examiner

*Primary Examiner*—Stephen Avila
(74) *Attorney, Agent, or Firm*—McHale & Slavin, P.A.

(57) ABSTRACT

A line handling device designed to facilitate positioning and handling of a mooring or docking line during a boat docking operation is removably mounted on an extendable pole, such as a boat hook. The device has an elongated body with a tapered end. A longitudinal groove is formed in the body to accommodate the shaft of the boat hook. A flexible resilient fastener is attached to the body and encircles the shaft of the boat hook. A docking line may be wedged between the clip and the shaft of the boat hook to form a loop to engage a piling.

15 Claims, 2 Drawing Sheets

BOAT HOOK ATTACHMENT

FIELD OF THE INVENTION

This invention relates to nautical line handling devices, and more particularly to a clamp on device for use with existing boat hooks for handling and positioning mooring lines.

BACKGROUND OF THE INVENTION

The present invention relates to an attachment to boat hooks for the purpose of providing an improved arrangement for positioning an end loop of a boat line around a piling, cleat, or other fixed object.

In the hands of a capable captain, a boat traveling at moderate speeds in open water is considered to be relatively safe from damage. However, as a boat approaches a dock or slip, the boat will lose most all maneuverability since water flow past the boat rudders is greatly reduced. During this time, the boat is at a high risk of damage should wind, waves or current cause movement of the boat. For this reason, it is critical that the boat is tied to a fixed object as quickly as possible.

By way of illustration, a common means for securing a boat is by attachment to a piling. A piling is typically a large wood or cement column embedded in the earth beneath the water body. A bitter end of a line is formed into a loop and placed around the piling, with the opposite end secured to the boat. A problem, which this invention addresses, is the difficulty in placing the looped end of the line around the piling. Some boaters attempt to throw the loop, lasso-style, while others rely on a second crew member for assistance. Still other boaters employ a line handling device to place the looped end of the mooring line around a piling or cleat. Unfortunately, current line handling devices have many shortcomings.

For example, U.S. Pat. No. 3,841,685 discloses a line handling device designed to secure a mooring line to a piling. The device uses a slotted circle to lower a loop of line around a piling. Unfortunately, this device is not adjustable and, therefore, only works on pilings which fit within its preset dimensions.

Some line handling devices, like U.S. Pat. No. 4,004,539 and U.S. Pat. No. 5,699,748, were designed with large frames to accommodate pilings of various sizes. These line handling devices were found to work with a wide variety of pilings, but they also created new problems: they were hard to store and required two-handed control of the device. This two-handed line handling operation thereby reduced the boater's ability to use his or her hands to control the boat during docking.

Accordingly, one-handed line handling devices were developed. U.S. Pat. No. 4,009,181 discloses a line handling device which places line-stiffening members onto the looped end of a mooring line. This device allows one-handed placement of a line, but poses preparation problems. For example, based on weather or water currents, different numbers of mooring lines may be required during different docking sessions.

Accordingly, what is needed in the art is a line handling device that may be quickly, conveniently, and effectively used to accommodate a variety of dock pilings or cleats, and should also be is easy to store.

SUMMARY OF THE INVENTION

The present invention is a line handling device used to facilitate the handling of a mooring line when a user is securing a boat to a dock or piling. The device employs a clip resiliently connected to one end of an extendable pole, such as a conventional boat hook. When attached to the handle, the clip forms a biased slot between the handle and the clip in which a docking line may be frictionally secured.

The distal end of the boat hook provides support for the loop end of a mooring line which has been draped around the outside contours of the hook portion. A length of line greater than the distance between the hook and the clip extends back along the handle to the clip. The line is secured between the clip and the handle to keep the loop in place.

The line handling device is used during the securing of a boat to help a user place and secure the loop end of a mooring line around a piling or dock cleat. First, the user adjusts the loop end of the mooring line to create a loop having roughly the same outer dimensions as the piling or docking cleat. Next, the user rests the loop on the hook portion of the boat hook, positioning the line between the shaft of the handle end of the hook. Extra length of line is then led back to and secured in the clip. This shapes the loop so that it may be lowered around a piling or dock cleat which is within reach of the extendable pole. The user then lowers the supported loop end of the mooring line around the cleat or piling. Using a horizontal motion, the user pulls the device away from the cleat or piling. As the device is drawn towards the user, the mooring line's adjustable loop will engage the cleat or piling and become separated from the boat hook. The loop may then be drawn tight about the cleat or piling by pulling on the mooring line's non-looped end.

After use, the line handling clip may be broken down for storage by removing the clip from the extendable pole. The clip is attached to the pole by a releasable spring biased fastening. The clip is usually oriented parallel with the longitudinal axis of the pole and may remain connected to the pole, if desired.

Accordingly, it is an object of the present invention to provide a line handling device that facilitates the handling and securing of a mooring line, without requiring special preparation or alteration of the line.

Yet another object of the present invention is to provide a line handling device that facilitates the handling and securing of a mooring line, the device being self-contained and having no components which separate from the device during use.

A further object of the present invention is to provide a line handling device that facilitates the handling and securing of a mooring line, the device being modular and easy to store.

Still another object of the present invention is to provide a line handling device used to facilitate the handling and securing of a mooring line, the device being capable of use with several unaltered mooring lines during a single mooring operation.

Another object of the present invention is to provide a line handling device that is easily attached and removed from any boat hook to facilitate a single clip's use on various line handling devices, as needed.

Still another object of the present invention is to provide a low cost clip that can be used on any diameter boat hook, and any diameter line.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention is described in terms of a specific embodiment, it will be readily apparent to those skilled in this art that various modifications, rearrangements and substitutions can be made without departing from the spirit of the invention. The scope of the invention is defined by the claims appended hereto.

Figure 1:
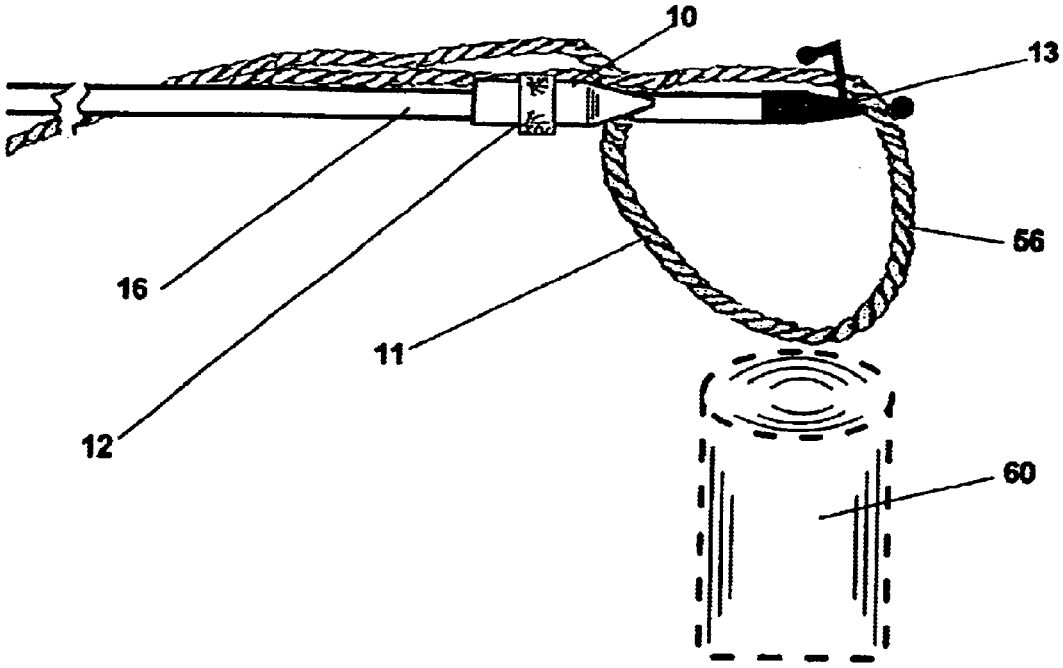
FIG. 1 is a perspective view showing the present invention being used to place a mooring line around a piling.
Figure 2:
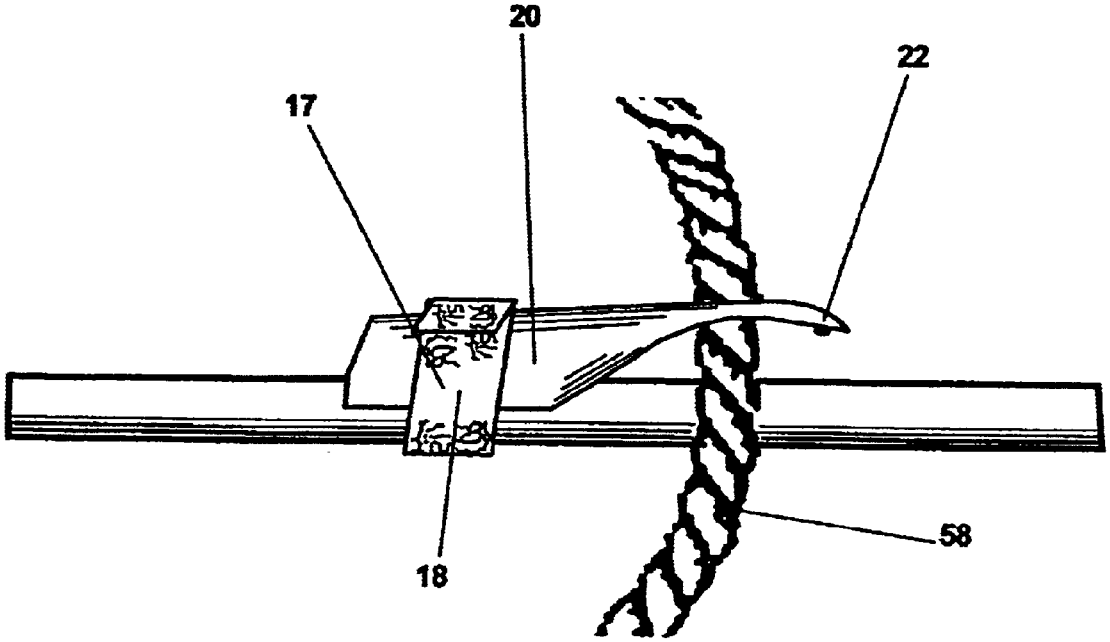
FIG. 2 is a perspective view showing the present invention mounted on a pole.

Reference is now made to FIGS. 1 and 2, wherein the line handling device 10 of the present invention is shown. The device 10 facilitates the handling and securing of a mooring line 56 to a piling 60. The device 10 comprises a clip 12 connected to an extendable pole 16. In FIG. 1, the pole is a conventional boat hook with an h shaped portion 13 on the distal end. The loop 11 of the mooring line 56 is loosely supported by the distal end of the boat hook such that the shaft of the boat hook forms a rigid diametrical arm. An excess of line, greater than the distance between the distal portion of the hook and the clip 12, forms the loop 11. The loop 11 is then manipulated by the extendable pole 16 to encircle the piling 60.

Figure 3:
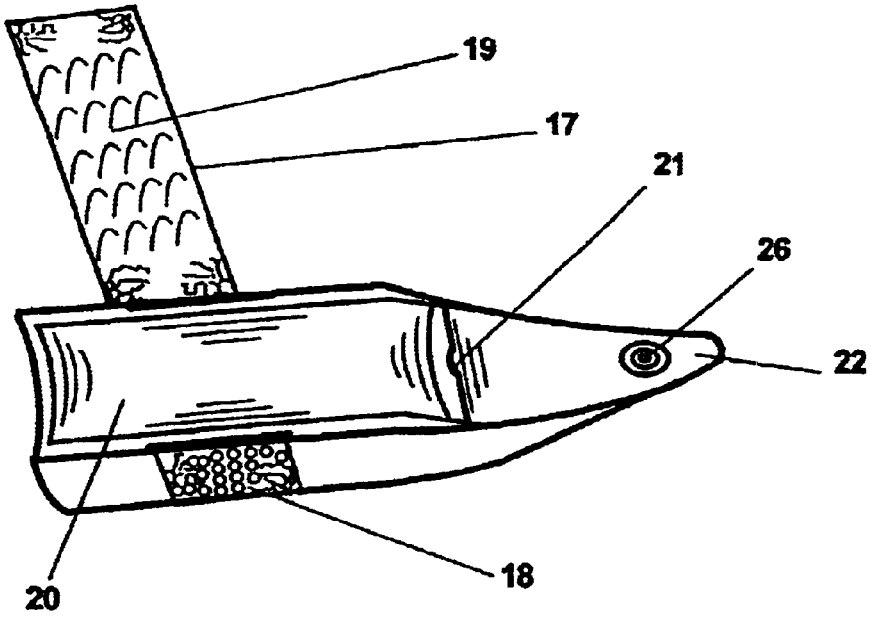
FIG. 3 is a perspective view showing the present invention dismounted.

Now referring to FIGS. 2 and 3, the clip 12 is removably connected to the pole 16 by a flexible belt 17. One end 18 of the belt is permanently fixed to the clip by mechanical fasteners, adhesives, or molding. The belt 17 is somewhat resilient. The resiliency may result from the structure, i.e. knitting, weaving or nonwoven, or the inclusion of elastic yarns, or both. The belt is wrapped around the shaft of the pole 16 to secure the clip to the pole.

Further, the belt may be made with a hook-and-loop fastener, such as Velcro, 19 along the length with the hooks on one side of the belt and the loops on the other. The free end of the belt is overlapped with the fixed end 18 and a releasable connection is formed. Of course, other releasable fasteners may be incorporated in the belt, such as a buckle, snap fasteners, buttons and holes, etc..

The clip 12 has a rounded elongated body 20 that tapers to a smaller apex 22. One surface of the body has a longitudinal groove 21 which accommodates the curvature of the pole 16. The groove 21 may not extend the entire length of the body. The narrow end 22 of the tapered body provides clearance between the shaft and the clip for ease in feeding the line into the slot between the pole and the clip. At the narrow end of the body there is a raised detent 26 is formed on the body. The detent 26 acts as a stop to prevent the line from disengaging from the slot.

Figure 4:
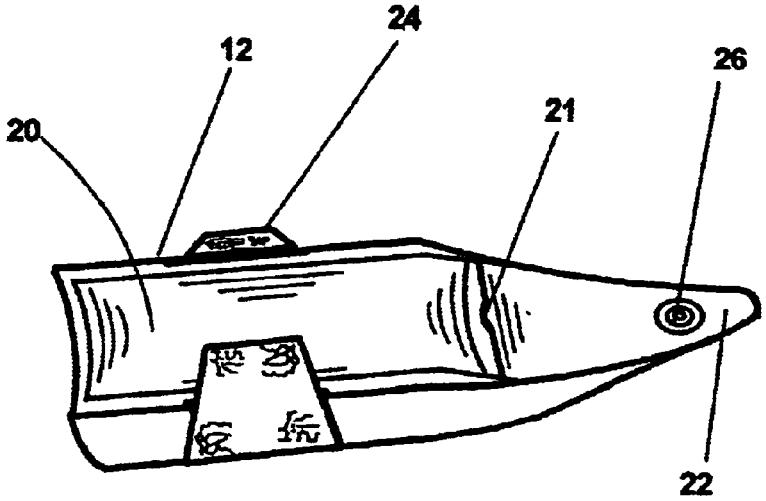
FIG. 4 is a perspective of another embodiment of the present invention.

Referring to FIG. 4, the clip 12 is identical in form to the clip shown in the other Figures. The releasable fastener is a semi-circular spring 24 that encircles the clip body 20 and extends outwardly to approximate the diameter of conventional boat hooks. By forcing the spring 24 about the shaft of a pole a spring bias is effected to connect the clip to the pole. The body 20 and the spring 24 are fixed together by mechanical fasteners, adhesives or molding. The spring 24 is shown as semi-circular but may have two arms extending from opposite sides of the body.

In preparation for use of the device 10, the clip 12 is placed on the extendible 16 at a distance from the distal end that is greater than the diameter of the piling to be captured. This can be done by merely squeezing the grooved clip and pole together with one hand and wrapping the belt about the pole and clip with the other hand. When so positioned, the free end of a docking line is draped over the distal end of the pole and brought back to the clip. The line is then wedged into the slot between the pole and the clip and held in position by the resiliency of the clip fastener.

When a suitable piling or cleat 60 is within line-deployment range, the looped end 56 of the line 58 is placed around the piling or cleat 60. Once the piling or cleat 60 is located within the looped end 56 of the line 58, the device 10 is withdrawn from the piling or cleat 60. Upon withdrawal, the looped end 56 of the mooring line 58 engages the piling 60. The loop end 58 may then be tightened around the piling or cleat 60 by pulling on the non-looped end (not shown) of the mooring line 58. Once the looped end has been drawn tight, the line can then be secured to a boat, not shown, in the normal manner.

After the line has been removed from the clip, the clip may be removed from the pole or boat hook, if desired, and placed in a storage compartment or pocket. Because the clip is unobstrusive and aligned with the shaft of the pole, it may remain secured to the pole.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. An apparatus for use with a pole in positioning a docking line, said apparatus comprising:

a clip having an elongated body and a tapered free end;

a flexible resilient fastener fixed to said body;

said fastener adapted to provide resilient connection between said clip and the pole and said free end and the docking line; and said fastener including a releasable means for connecting said clip to the pole;

whereby said clip facilitates positioning of a docking line by maintaining a line loop sized to encircle a piling.

2. The apparatus according to claim 1, wherein said fastener is formed of a flexible belt.

3. The apparatus according to claim 1, wherein said fastener is a semicircular spring.

4. The apparatus according to claim 1, wherein said elongated body includes a longitudinal groove.

5. The apparatus according to claim 2, wherein said elongated body includes a longitudinal groove.

6. The apparatus according to claim 3, wherein said elongated body includes a longitudinal groove.

7. The apparatus according to claim 1, wherein said tapered end of said body has a raised detent.

8. An apparatus for positioning a mooring line, said apparatus comprising:

an extension pole having an elongated shaft with a distal end;

a clip having a body with a free tapered end;

a flexible resilient fastener permanently affixed to said clip;

said fastener in the form of an elastic belt with a first end and a second end; and releasable fastening means on said first end and said second end of said belt;

whereby said belt forms a releasable coupling about said pole and said clip and facilitates positioning of a mooring line by resiliently maintaining a line loop between said shaft and said free tapered end of said clip.

9. The apparatus of claim 8, wherein said fastener is a semi-circular spring; and said spring bias forms said releasable fastening means.

10. The apparatus of claim 8, wherein said extension pole is a boat hook.

11. The apparatus of claim 9 wherein said extension pole is a boat hook.

12. In a boat handling device for docking a boat having a boat hook with a hook end and a handle end and a docking line removably attached to said hook end, the improvement comprising an elongated clip resiliently connected to said handle end, said clip including an attachment end and a free end, a resilient fastener fixed to said attachment end and said handle end to permit said free end limited movement, said docking line frictionally held between said free end and said handle end to form a loop.

13. In a boat handling device of claim 12 wherein said resilient fastener comprises a flexible belt surrounding said attachment end and said handle end.

14. In a boat handling device of claim 13 wherein said belt is discontinuous with a first end and a second end, complementary fastening means on said first end and said second end for repeated fastening and unfastening of said ends.

15. In a boat handling device of claim 13 wherein said resilient fastener is a semi-circular spring, said attachment end disposed between said semi-circular spring and said handle end.

* * * * *